United States Patent [19]

El Sakkaf

[11] Patent Number: 4,602,441

[45] Date of Patent: Jul. 29, 1986

[54] VENTILATED SHOE

[76] Inventor: Sherif M. El Sakkaf, 5, Rue Eugène-Pittard, Geneva, Switzerland

[21] Appl. No.: 725,987

[22] Filed: Apr. 22, 1985

[30] Foreign Application Priority Data

Dec. 28, 1984 [CH] Switzerland ..... 6223/84

[51] Int. Cl.[4] ..... A43B 7/06; A43B 7/08; A43B 13/20

[52] U.S. Cl. ..... 36/3 R; 36/3 B; 36/29

[58] Field of Search ..... 36/3 R, 3 A, 3 B, 29; 128/594

[56] References Cited

U.S. PATENT DOCUMENTS 4,078,321 3/1978 Famolare, Jr. ..... 36/3 B
4,343,097 8/1982 Sasaki ..... 36/3 A
4,451,994 6/1984 Fowler ..... 36/29 X

FOREIGN PATENT DOCUMENTS 979643 12/1975 Canada ..... 36/3 B
3221680 1/1983 Fed. Rep. of Germany ..... 36/29

*Primary Examiner*—James Kee Chi
*Attorney, Agent, or Firm*—Martin Smolowitz

[57] ABSTRACT

The shoe (1) includes a flexible sole (2) containing a cavity (3) which has nearly the same size as the sole. The walls of the cavity are airtight and flexible in such a manner that the portion of the cavity receiving the foot pressure squashes. The top wall, for example of the front portion of the sole, is provided with at least one opening (4) allowing the air to go into the cavity. The side wall, for example of the rear portion of the sole, is provided with at least one opening (5) allowing only the air to go out from the cavity.

The shoe ventilated as described is used in sport.

6 Claims, 1 Drawing Figure

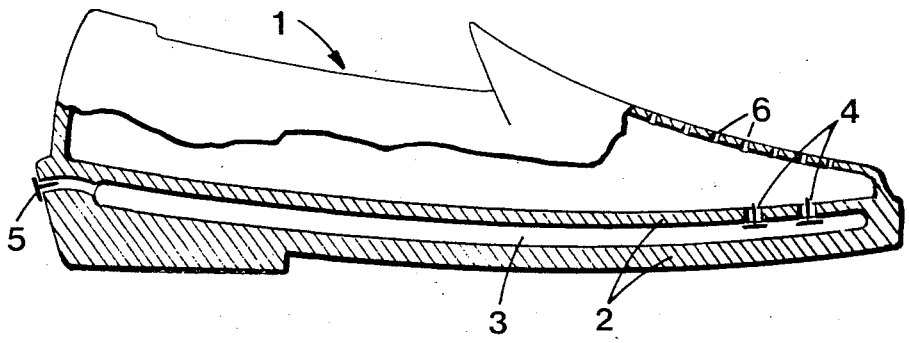
1
6
4
5
3
2

VENTILATED SHOE

The invention concerns a ventilated shoe with a sole containing a cavity. Such a shoe can be used for sport.

It is known that ventilated insoles can be introduced into shoes. Such a solution generally compels the user to select a shoe of bigger size than the one fitting to his foot and which, therefore, is usually not adapted best to his foot form. Additionally, the ventilation of an internal insole in a shoe allows only a reduced air exchange with the atmosphere, because the air circulation takes place inside the shoe.

In order to avoid these deficiencies, the aim of the invention is to constrain an air exchange with the atmosphere surrounding the shoe without incurring the difficulties arising for instance by immersion when one steps into a water puddle.

The ventilated shoe of the invention satisfies these requirements and is defined by the claims.

The invention will be better understood with the help of the following description of an embodiment of the invention given as example and represented in the FIGURE with reference numerals.

A shoe 1 of usual form includes a sole 2, which contains a flat cavity 3 provided with approximately the same form as the sole but of course slightly smaller. The cavity 3 is enclosed in airtight walls. The sole 2 is made in such a manner that, when a portion of the sole is compressed by a portion of the foot of a user, the top and bottom walls of the cavity come nearer together over this compressed portion and the air volume of this portion of the cavity has practically vanished. When the sole compression is over, the cavity 3 gets again its initial form and contains a determined volume of air. This flexibility of the sole form in front of the compression is provided by the provision of an adequate form and flexibility of the sole walls, especially of the sidewalls of the sole.

Some resilient support pieces can be placed in the cavity 3 between the top and the bottom walls (not represented in the FIGURE). Under the strength of the compression, they will squash; and without compression they reinstate the initial form of the cavity, whereby they contribute to realize the required flexible operation of the sole 2 described above.

The flat cavity 3 in the sole 2 is connected to the outside atmosphere firstly by one or several openings 4 in the front top wall of the sole. These front openings 4 are disposed in a manner which makes them operate as one-way valves, allowing only the air to go in a closing at the slightest overpressure of the air in the cavity 3 with respect to the atmosphere.

Secondly, the cavity 3 is connected to the outside atmosphere by one or several openings 5 provided in the rear side wall of the sole. The rear openings are disposed in a manner which makes them operate as one-way valves allowing only the air to go out, and closing at the slightest underpressure of the air in the cavity with respect to the atmosphere.

Ventilation holes 6 are provided in the front upper wall of the shoe.

When a user is walking with the shoe 1, the sole 2 takes the form represented in the FIGURE when the foot is lifted from the ground and when no compression is applied to the shoe.

When the user puts his foot on the ground, usually his heel first, the rear portion of the sole 2 is compressed, the air in the cavity 3 gets overpressure and escapes partially through the rear opening 5 operating as a one-way outlet valve. Then the weight of the body moves from the rear to the front of the sole, and then the sole is lifted from the ground. Therefore, the volume of the cavity 3 soon starts to increase, air is sucked into the front openings 4 operating as one-way inlet valves. This air comes from under the front portion of the foot and automatically fresh air from the atmosphere enters from outside the shoe to replace it. The foot of the shoe user is therewith ventilated. This ventilation can be reinforced by the ventilation holes 6 provided in the front upper wall of the shoe.

On the other hand it can be seen that, when the front of the shoe steps into a puddle, the water cannot enter into the cavity 3 because the openings 4 are provided inside the shoe. The rear openings 5 of the sole is either closed or operating as an air outlet of the cavity. Water or dirtiness cannot, therefore, enter into the cavity 3 through this opening 5.

Within the scope of the invention it is easy to imagine other embodiments. For example, the air inlet openings can be provided at the rear of the sole, or at the rear and in the middle of the sole, or even by distributed onto all the top wall of the sole.

On the other hand, one or several outlet openings, still disposed in the side wall of the sole, can be provided in the front portion or in the front portion and the middle, or even by distributed around the sole. The various positions of the inlet openings can freely be combined with the various positions of the outlet openings.

I claim:

1. A ventilated shoe with an integrated flexible sole, comprising: a flexible sole containing a cavity having nearly the same form and slightly smaller size as the sole, the walls of the cavity being airtight, flexible and disposed in a way that the portion of the cavity receiving a foot pressure is squashed, and when removing the pressure of the foot the flexible wall reinstate the initial form of the cavity in the portion of the shoe which does not receive the foot pressure, that the top wall of the sole carries at least one opening which can be closed, operating as a one-way valve allowing only the air to go in and preventing the air from going out, and that the sidewall of the sole carries at least one opening which can be closed, operating as a one-way valve allowing only the air to go out and preventing the air from going into the cavity.

2. The ventilated shoe of claim 1, wherein the front upper wall of the shoe contains ventilation holes.

3. The ventilated shoe of claim 1 or 2, wherein at least one air inlet opening is provided in the front portion of the sole and at least one air outlet opening is provided in the rear portion of the sole.

4. The ventilated shoe of claim 1 or 2, wherein at least one air inlet opening is provided in the rear portion of the sole and at least one air outlet opening is provided in the front portion of the sole.

5. The ventilated shoe of claims 1 or 2, wherein several air inlet openings are distributed over the top wall of the sole.

6. A ventilated shoe with an integrated flexible sole, comprising: a front upper wall containing ventilation holes; a flexible sole containing a cavity having nearly the same form and slightly smaller size as the sole, the walls of the cavity being airtight, flexible and disposed in a way that the portion of the cavity receiving a foot pressure is squashed, and when removing the pressure of the foot the flexible walls reinstate the initial form of the cavity in the portion of the shoe which does not receive the foot pressure, that the front portion of the top wall of the sole carries at least one opening which can be closed, operating as a one-way valve allowing only the air to go in and preventing the air from going out, and that the rear portion of the sole sidewall carries at least one opening which can be closed, operating as a one-way valve allowing only the air to go out and preventing the air from going into the cavity.

* * * * *